United States Patent [19]

Wright

[11] Patent Number: 4,665,623

[45] Date of Patent: May 19, 1987

[54] ILLUMINATED DRAFTING AID

[76] Inventor: Charles W. Wright, 14570 English Rd., Miami Lakes, Fla. 33014

[21] Appl. No.: 826,235

[22] Filed: Feb. 5, 1986

[51] Int. Cl.[4] ..... B43L 13/02

[52] U.S. Cl. ..... 33/468; 33/419; 33/493; 33/562; 362/109

[58] Field of Search ..... 33/468, 470, 437, 469, 33/425, 419, 473, 493, 562, 564; 362/109, 31

[56] References Cited

U.S. PATENT DOCUMENTS 798,721 9/1905 Wilson ..... 33/468
1,045,695 11/1912 Goldwater ..... 33/468
3,375,588 4/1968 Pelham ..... 33/564
4,075,467 2/1978 Peterson ..... 362/109 X
4,359,825 11/1982 Erickson ..... 33/564

*Primary Examiner*—William D. Martin, Jr.
*Attorney, Agent, or Firm*—Richard L. Miller

[57] ABSTRACT

A drafting T-square including a base block with a pivotable straight bar which can be manipulated as a protractor. A scale is slidable along the straight bar for extending beyond the straight bar. A further arm is pivotable with respect to the straight bar. A lamp on the base block illuminates the straight bar for providing illumination to the area to be drawn.

4 Claims, 6 Drawing Figures

ILLUMINATED DRAFTING AID

BACKGROUND OF THE INVENTION

This invention relates generally to instruments for use by engineers and draftsmen to graphically draw various plans. More specifically it relates to a T-square instrument such as is guided along a straight edge of a drafting table for plotting straight lines.

It is well known to all to all draftsmen that various other drafting instruments must be used in conjunction with a T-square in order to draw plans having lines in all different directions. Thus various shaped triangles, protractor triangles, templates or other aids must be slided along a T-square for accomplishing the task; each instrument being selectively picked up whenever needed and thereafter removed after each use for replacement with another, all of which takes up a considerable total amount of time. This situation is objectionable and therefore in want of an improvement.

SUMMARY OF THE INVENTION

Accordingly, it is a principal object of the present invention to provide a drafting aid which eliminates the task of selectively picking up different drafting instruments as needed together with a T-square, thereby saving on time, and which additionally includes self-contained illumination for better visibility of the drawing where needed, thus eliminating the extra chore of shifting a nearby lamp.

Other objects are to provide an illuminated drafting aid which is simple in design, inexpensive to manufacture, rugged in construction, efficient in use and precisely accurate in results.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF PREFERRED EMBODIMENT

Figure 1:
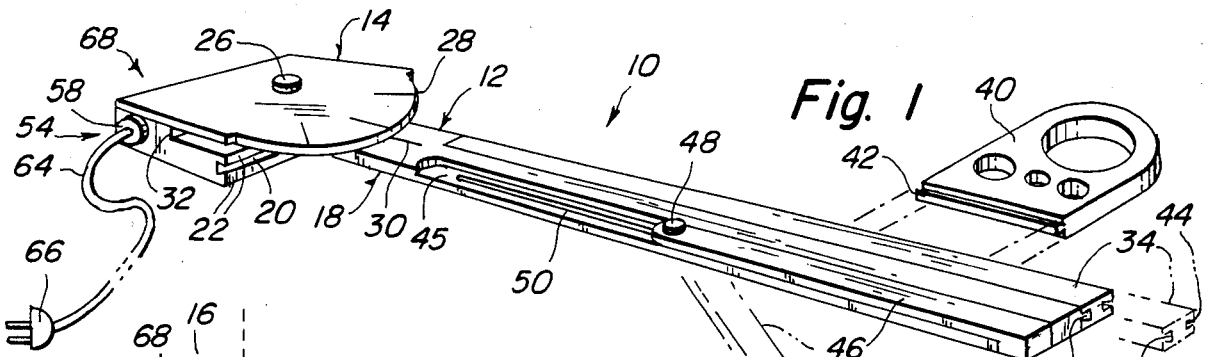
FIG. 1 is a perspective view of the invention.

Referring now to the drawing in greater detail, the reference numeral 10 represents an illuminated drafting aid, according to the present invention, wherein there is a T-square 12 comprised of a base block 14 for sliding along a straight edge 16 of a drafting table and a straight bar 18 attached to the base block for placement on top of a sheet of drawing paper secured upon the drafting table. The base block includes a keystone-shaped groove 20 along its sliding edge 22 for engaging a correspondingly shaped tongue 24 along the table edge 16, thereby insuring against disalignment of edges 16 and 22 and resultant inaccurate draftmanship such as commonly occurs with a hand-held T-square.

In the present invention, the straight bar is pivotally mounted on the base block by a pivot screw 26. A protractor 28 formed on the base-block includes a rounded edge calibrated in degrees for alignment with a reference line 30 marked on the bar 18. Thus the bar serves as a pivotable arm of the protractor for drawing lines at any selected angle. A notch 32 on the base block receives a rounded end of the pivotable bar.

The bar is notched along one longitudinal edge for housing a scale 34 slidably held therein by means of a tongue 36 and groove 38, so that the scale may be selectively extended from an end thereof, or the scale may be inverted if made with calibrations reading in reverse directions on opposite sides thereof, or if one side is calibrated in inches and the other side is calibrated in metric measurements.

An outer longitudinal edge of the scale is made to slidably support any form of template 40, or the like, by means of a tongue 42 and groove 44.

A depression 45 along an opposite longitudinal side edge of the bar contains a pivotable arm 46 on a screw 48 slidable in a slot 50 of the bar. The screw may be tightened so as to lock the arm at any inclined angle and along any point of the slot. The arm may be marked with any scale calibrations, as shown at 52.

Figure 6:
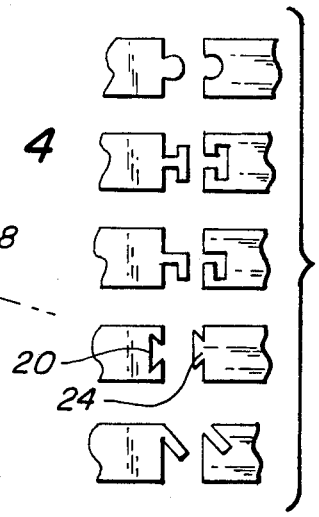
FIG. 6 is an end view of several different designs of interfitting tongue and groove constructions that may alternately be used in the invention.

Any of the above-described, inter-engaging tongues and grooves may be made in a design other than keystone-shaped, as shown and suggested in FIG. 6.

Figure 2:
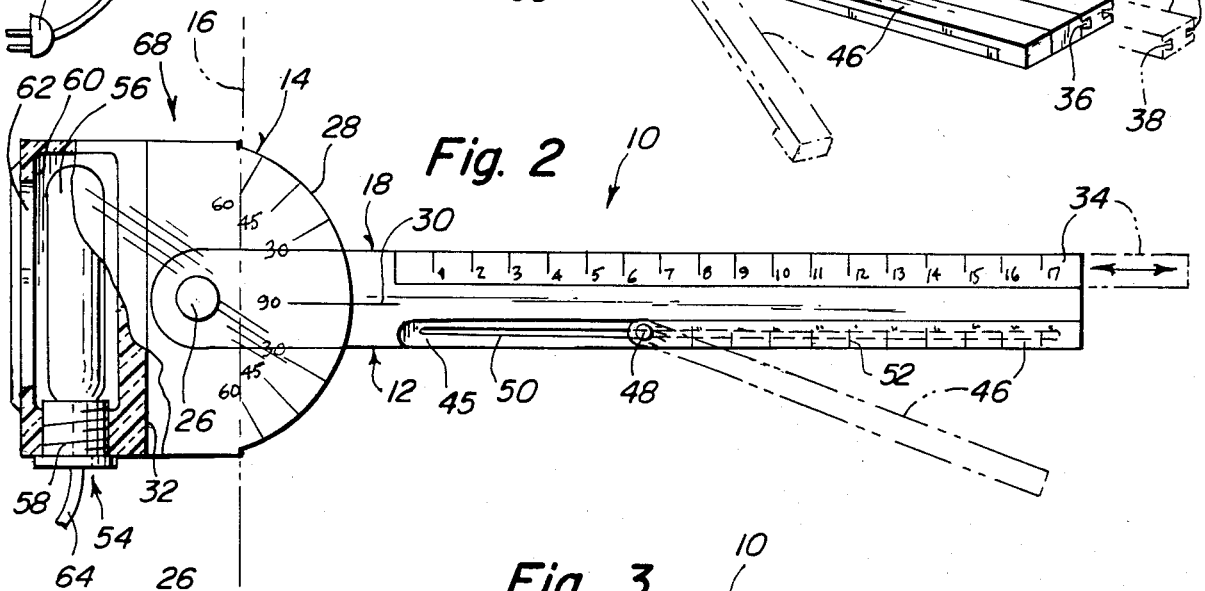
FIG. 2 is a top, plan view thereof.
Figure 3:
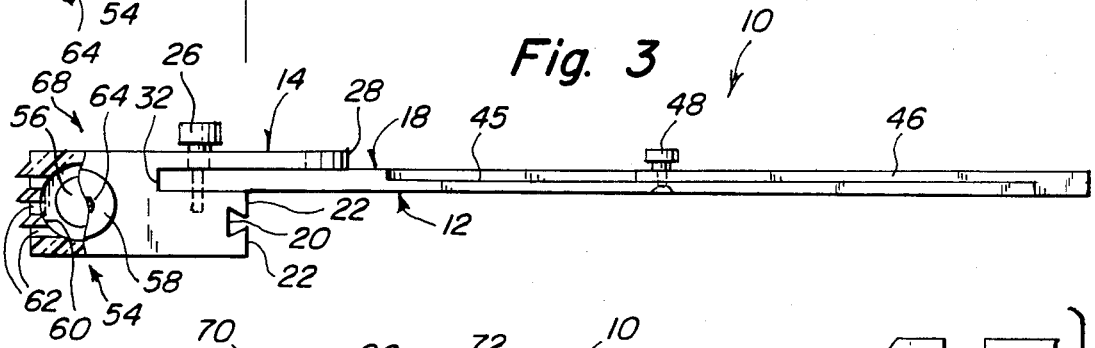
FIG. 3 is a front edge view thereof.
Figure 4:
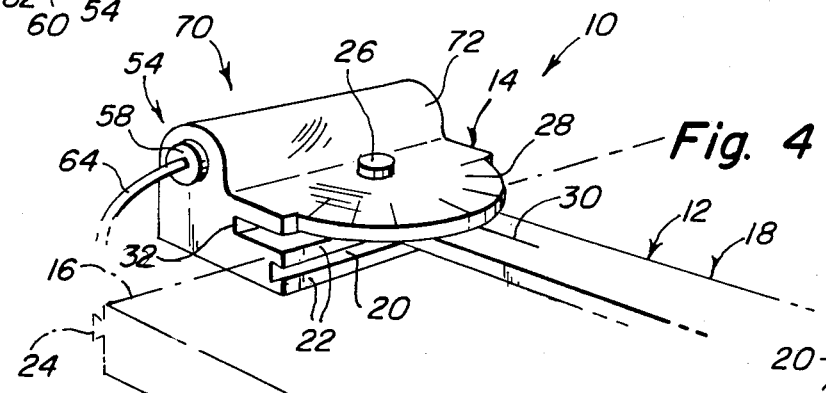
FIG. 4 is a fragmentary perspective view of a modified design of the invention showing the lamp being located on the top.
Figure 5:
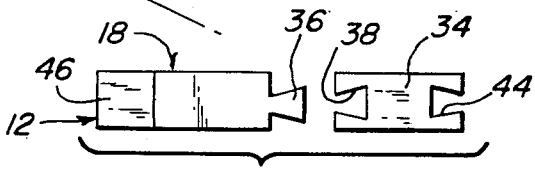
FIG. 5 is a right side end view of the straight edge shown in FIG. 2, and showing the slidable scale detached therefrom.

The invention incorporates an illumination assembly 54 which includes the base block and the bar components being molded either of transparent plastic such as LUCITE® so as to transmit light and permit visibility therethrough. The assembly also includes an electric lamp 56 in a socket 58 screwed into the base block and a chamber 60 in the base block housing the lamp. Slots 62 ventilate the chamber for escape of lamp heat. An extension cord 64 from the socket has a plug 66 on its end for connection to a household electric outlet socket. An embodiment 68 of the invention, shown in FIGS. 1 to 3, has the base block flat on top, whereas the embodiment 70, shown in FIG. 4, has a raised position 72 on the base block containing the lamp so that it throws light rays sidewardly over the top of the entire device.

In operative use, it is now evident that the device 10 serves the purpose of several different drafting instruments and also includes illumination on the drafting job.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An illuminated drafting aid, comprising, in combination, a T-square, a slidable scale and a pivotable arm mounted on said T-square, and said T-square including illumination means for illuminating a drafting work, said T-square comprising a base block for sliding along a straight edge of a drafting table, and a straight bar pivotally attached to said base block, a notch formed in said base block for receiving and end of said straight bar with a roof of said base block forming the top of the notch and overlying the straight bar, the outer edge of the roof being arcuate and forming a protractor edge, a reference line formed on said straight bar for indicating the angle to be drawn, whereby the angle on the protractor is identical to the angle being drawn along the straight bar.

2. The combination as set forth in claim 1, and comprising a tongue and groove arrangement between said scale and said straight bar wherein said scale is slidable outwardly from an end of said straight bar, the scale being reversible wherein the outer edge also comprises a corresponding tongue and groove arrangement with the straight bar and further comprising a template adjustably mounted on said T-square and comprising a tongue and groove arrangement with the scale whereby the template can be mounted on either side of said scale.

3. The combination as set forth in claim 2, wherein said arm is slidable along said straight bar and also sidewardly pivotable therefrom.

4. The combination as set forth in claim 3, wherein said illumination means includes an electric lamp mounted on said T-square base block, said block and straight bar being of LUCITE® material for passing the light therethrough.

* * * * *